US011401071B2

(12) United States Patent
Van Heck

(10) Patent No.: US 11,401,071 B2
(45) Date of Patent: Aug. 2, 2022

(54) METHOD, APPARATUS AND SYSTEM FOR ATTACHING A LABEL ON A PRODUCT

(71) Applicant: Fuji Seal International, Inc., Osaka (JP)

(72) Inventor: Marinus Antonius Leonarda Van Heck, Deurne (NL)

(73) Assignee: Fuji Seal International, Inc., Osaka (JP)

( * ) Notice: Subject to any disclaimer, the term of this patent is extended or adjusted under 35 U.S.C. 154(b) by 147 days.

(21) Appl. No.: 16/796,969

(22) Filed: Feb. 21, 2020

(65) Prior Publication Data

US 2020/0270009 A1 Aug. 27, 2020

(51) Int. Cl.

| | |
|---|---|
| ***B65C 9/24*** | (2006.01) |
| ***B65C 3/06*** | (2006.01) |
| ***B65C 3/08*** | (2006.01) |
| ***B65C 9/02*** | (2006.01) |
| ***B65C 9/40*** | (2006.01) |

(52) U.S. Cl.

CPC ..... *B65C 9/24* (2013.01); *B65C 3/065* (2013.01); *B65C 3/08* (2013.01); *B65C 9/02* (2013.01); *B65C 9/40* (2013.01)

(58) Field of Classification Search

CPC .. B65C 3/065; B65C 9/24; B65C 9/25; B65C 2009/0037

See application file for complete search history.

(56) References Cited

U.S. PATENT DOCUMENTS

| | | | | |
|---|---|---|---|---|
| 3,591,767 | A * | 7/1971 | Mudie | B65B 53/02 219/244 |
| 2002/0179718 | A1* | 12/2002 | Murokh | B41M 5/26 235/487 |
| 2003/0015274 | A1* | 1/2003 | Mallman | B29C 66/135 156/69 |
| 2010/0290021 | A1* | 11/2010 | Pazidis | G02B 5/0833 355/67 |

FOREIGN PATENT DOCUMENTS

| | | | |
|---|---|---|---|
| WO | 2011/031160 | A1 | 3/2011 |
| WO | 2013/073938 | A1 | 5/2013 |
| WO | 2014/006033 | A1 | 1/2014 |
| WO | 2017/213506 | A1 | 12/2017 |

* cited by examiner

*Primary Examiner* — Philip C Tucker
*Assistant Examiner* — John Blades
(74) *Attorney, Agent, or Firm* — Locke Lord LLP

(57) ABSTRACT

The present disclosure relates to a method of attaching a shrinkable label on at least one product wherein the shrinkable label comprises a film comprising heat shrinkable material and photothermic material, the method comprising:

transporting a plurality of products on a product conveyor through an irradiation volume defined by a plurality of UV light emitters arranged sideways of the product conveyor;

arranging at least one reflector between consecutive products on the product conveyor while the at least one product is being transported;

controlling the UV light emitters to emit UV-light towards the shrinkable label arranged around the at least one product in the irradiation volume and towards the at least one reflector arranged between consecutive products in order for the photothermic material of the shrinkable label to heat up causing the heat shrinkable material to shrink around the at least one product.

17 Claims, 7 Drawing Sheets

METHOD, APPARATUS AND SYSTEM FOR ATTACHING A LABEL ON A PRODUCT

The present disclosure relates to a method, apparatus and system for attaching a shrinkable label on a product wherein the shrinkable label comprises a film comprising heat shrinkable material and photothermic material.

Sleeving systems have been developed for efficiently attaching sleeve-like labels (herein also referred to as "labels" or "sleeves") on products, such as containers (for instance food containers, bottles, jars, bowls, holders, etc.). Examples of such sleeving systems are described in WO 2011031160 A1, WO 2013/073938 A1 and WO 2014/006033 A1. These sleeving systems are aimed at arranging sleeves (labels) around products by feeding a continuous strip of flattened tubular heat-shrinkable label material towards a spreading element, transporting the tubular label material along the outer surface of the spreading element so as to open the label material, cutting the label material to form sleeve-shaped labels and discharging the labels from the spreading element towards a row of products passing on a conveyor below or above the spreading element. In other examples the tubular label material is cut to form sleeves before the tubular label material is opened. The labels are arranged more or less loosely around each of the products and subsequently attached to the product by guiding the products through an oven. The labels are made of heat-shrinkable material and carrying the product through the hot air and/or steam generated in the oven causes the label to shrink and to thereby get firmly attached to the product.

A drawback of using hot steam and/or hot air to activate the shrinkable label material in order to shrink the label onto the products is that the hot air and/or steam may undesirably heat or even damage the substance contained within the product. Furthermore, labels shrunk using hot steam and/or air often do not conform completely to all of the contours of the product, especially if the product has a complex shape.

It is known as such to use UV light to activate the shrinking of the shrinkable label material. In this case the shrinkable label is still made of heat shrinkable material, but the heat is generated inside of the label instead of being applied from the outside because the label material is able to absorb the UV light and convert the absorbed UV light into thermal energy. Consequently, the label material absorbing the UV light is heated up which causes the label to contract.

One type of UV light sources typically used in the irradiation of shrinkable labels concerns pulsed, gas-filled flash lamps or spark-gap discharge devices. These UV light sources are expensive, bulky, generate a lot of heat and tend to have a limited lifetime. Additionally, the shrink quality that can be achieved with these types of light sources may be relatively poor and/or it has been proven difficult to attach the labels on products on an industrial scale and/or in a sufficiently fast and reliable manner.

Another type of UV light sources recently developed by the inventors of the present application and applied to activate the shrinking of heat shrinkable labels is formed by semiconductor light sources or, more specifically, light emitting diode (LED) light sources configured to emit ultraviolet light by making use of electroluminescence. These light sources and several examples of how these light sources can be used to irradiate heat shrinkable label material arranged around one or more products are described in document WO 2017/213506 A1, the content of which being herein incorporated by reference.

The wavelength range(s) employed in the known UV light sources may enable good shrink results as such. For instance, using the UV light sources in these wavelength ranges may result in a relatively small color influence of the printed label material on the shrink results so that an even shrink result providing the label with the required (visual) color effect may be achieved. However, for good shrink results the light irradiated on the label material should be evenly distributed over the outer surface of the label. In some examples of the apparatus of WO 2017/213506 A1, for instance in the example of FIG. 8, the products on the conveyor are placed on a rotation unit that enables the products to rotate around an imaginary axis perpendicular to the transport direction of the conveyor, during their movement on the conveyor. In this manner essentially the entire outer surface of the label can be illuminated in a relatively uniform manner.

The rotation unit (more specifically a rotation unit enabling rotation of each of the plurality of products while at the same time being transported on the conveyor) makes the conveyor complex and costly and/or requires a high level of maintenance. Furthermore, if the products are bulky and/or in the case of combined products (for instance a number of products surrounded by a single label) there may be not enough space available between the UV light sources to enable the products to be rotated in an unimpeded manner.

By contrast, if the products are carried on the conveyor while being stably positioned thereon (and the products are not rotated) and the UV light sources are fixedly mounted relative to the conveyor so that the UV light sources are kept stationary (for instance, in case of the example of FIG. 6 of WO 2017/213506 A1), the label material may not always be irradiated such that the light impinging on the outer surface of the label is evenly distributed over the surface so that the shrink results may degrade.

A solution might be to cause the light to follow the movement of the product on the conveyor by making the UV light sources movable so as to follow the movement of the products on the conveyor. Another solution may be to cause the light to follow the movement of the product on the conveyor by making use of a moveable lens or reflector. Whether the UV light source(s) or the lens/reflector are movable (non-stationary) to allow the light to follow the movement of the products may depend on the situation. However, both these solutions involve complex and costly machinery enabling the UV light source(s) or the lens/reflector to move in such a manner that the light is able to follow the movement of the products.

It may be an object to provide a method and system of attaching labels to products wherein the above-mentioned and/or other drawbacks of existing methods and systems have been reduced.

According to a first aspect a method of attaching a shrinkable label on at least one product is provided wherein the shrinkable label comprises a film comprising heat shrinkable material and photothermic material, the method comprising:

- transporting a plurality of products on a product conveyor through an irradiation volume defined by a plurality of UV light emitters arranged sideways of the product conveyor, the UV light emitters being configured to irradiate at least one shrinkable label arranged around the at least one product;
- arranging at least one reflector between consecutive products on the product conveyor while the at least one product is being transported, the at least one reflector being configured to reflect UV light from the UV light emitters towards the shrinkable label;

controlling the UV light emitters to emit UV-light towards the shrinkable label arranged around the at least one product in the irradiation volume and towards the at least one reflector arranged between consecutive products in order for the photothermic material of the shrinkable label to heat up causing the heat shrinkable material to shrink around the at least one product.

The shrinking of the label causes the label to be attached to the product. Since the UV light is distributed more evenly over the circumferential outer surface of the label, the label is shrunk in a uniform manner around the product. This may result in a good and reliable attachment of the label to the product, while a pleasant appearance and/or a high level of positional accuracy may be achieved. Furthermore, these results may be achieved without the need for the products to be rotated during irradiation or even the light emitters to be moved around the product during irradiation. In embodiments of the present disclosure the products can be maintained at a fixed position relative to the moving product conveyor part, so that the conveyor and/or the control of the conveyor and light sources can be kept simple and reliable.

The at least one reflector may be configured to reflect the UV light from the UV light emitters towards at least one of a leading portion and a trailing portion of the shrinkable label. For instance, while the UV light emitters may irradiate the longitudinal sides of the label directly, the front and back sides of the label (seen in axial direction or transport direction of the product conveyor, herein also referred to as the leading and trailing sides of the label/sleeve) may be irradiated indirectly by directing the light to the reflectors which in turn direct the received light onto the front and back sides of the product.

The method may comprise positioning a first reflector to face the leading portion of the shrinkable label and a second reflector to face the trailing portion of the shrinkable label. Herein the first and second reflector may have been configured to reflect UV light towards both the leading portion and the trailing portion of the product.

The method may further comprise arranging a reflector unit between consecutive products on the product conveyor, wherein the reflector unit comprises a first reflector facing the leading portion of a shrinkable label of a first product and a different, second reflector facing the trailing portion of a shrinkable label of a second product.

The UV light emitters may irradiate at the same time a first reflector facing the leading portion of a shrinkable label of a first product and a second reflector facing the trailing portion of a shrinkable label of a second product. The first and second reflectors may be part of one and the same reflector unit or may be formed by separate reflectors, as will be explained later.

In embodiments of the present method the at least one reflector is transported synchronously with the at least one product. For instance, the method may comprise transporting a plurality of reflectors by using a reflector conveyor. The reflector conveyor may move the one or more reflectors through the irradiation volume with a speed corresponding with the speed of the product conveyor. More specifically, when the at least one reflector is co-moving with the at least one product, the reflector may be arranged essentially halfway between consecutive products on the product conveyor. In this manner, the reflector is positioned in the middle between the two consecutive products, where the distance between the reflector and a trailing portion of the first product is almost the same as the distance between a leading portion of the second product. Therefore the trailing portion of the first product may receive a similar amount of light as the leading portion of the second product The method may comprise irradiating one or more labels of one or more products while at the same the one or more products are moved past the UV light emitters. This can be done in an intermittent manner or in a continuous manner. For instance, the products may be transported intermittently and the irradiating and placement/removal of the reflectors may be performed when the products are stopped. Alternatively, the products may be transported continuously and both the irradiation and the placement and removal of the reflector(s) are performed when the products are moving. Alternatively, in case the product conveyor transports the product intermittently, the method may be configured to have the at least one reflector placed at a position between consecutive products and/or removed from a position between consecutive products (only) during the periods wherein the product is stopped, whereas the label of the product is irradiated with UV light (only) during periods wherein the product is moving.

The UV light emitters may be of the LED type (i.e. LED UV light emitters). The light emitters may be arranged to direct UV light substantially transversely of the transport direction of the product container towards the label of the product and to the reflectors. The reflectors may be positioned at a predefined distance from the leading and trailing portions of label, for instance halfway between the products.

The UV light emitters may have been arranged in at least one pattern essentially parallel to the transport direction of the at least one product on the product conveyor. In some embodiments the UV light emitters extend essentially parallel to the product conveyor, while in other embodiments at least some of the UV light emitters may extend obliquely relative to the transport direction of the product conveyor. Preferably the UV light emitters are positioned at both sides of the product conveyor so that the label can be irradiated on both their longitudinal sides.

The method may comprise directing the UV light from the UV light emitters through a diverging lens element so as to provide a divergent light beam on both the label and the one or reflectors.

According to another aspect an apparatus for attaching a shrinkable label on at least one product is provided, wherein the shrinkable label comprises a film comprising heat shrinkable material and photothermic material. The at least one product can be transported on a product conveyor through an irradiation volume.

The apparatus may comprise:

a plurality of UV light emitters arranged sideways of the product conveyor, the UV light emitters defining the irradiation volume and being configured to irradiate at least one shrinkable label arranged around the at least one product while the at least one product is transported through the irradiation volume;

a reflector arrangement unit for arranging at least one reflector between consecutive products on the product conveyor while the at least one product is being transported, the reflector arrangement unit comprising at least one reflector configured to reflect UV light from the UV light emitters towards the shrinkable label;

a controller configured to control the UV-light emitters to emit UV-light towards the shrinkable label arranged around the at least one product in the irradiation volume and towards the at least one reflector arranged between consecutive products in order for the photothermic material of the shrinkable label to heat up causing the heat shrinkable material to shrink around the at least one product.

In an embodiment the reflector arrangement unit is configured to arrange one or more reflectors at one or more positions between consecutive products on the product container.

In an embodiment the at least one reflector is configured to reflect UV light from the UV light emitters towards at least one of a leading portion and a trailing portion of the shrinkable label.

In an embodiment the reflector arrangement unit is configured to position a first reflector to face the leading portion of the shrinkable label and a second reflector to face the trailing portion of the shrinkable label, wherein the first and second reflector are configured to reflect UV light towards both the leading portion and the trailing portion of the product.

In an embodiment the apparatus comprises a reflector arrangement unit comprising a first reflector arranged to face the trailing portion of a shrinkable label of a first product and a second reflector arranged to face the leading portion of a shrinkable label of a second product, wherein the reflector arrangement unit is preferably configured to place the reflector unit between consecutive products on the product conveyor.

In embodiments of the present disclosure the reflector is configured to receive both first light from a first set of UV light emitters arranged next to the product conveyor at a first side thereof and second light from a second set of UV light emitters arranged next to the product conveyor at an opposite, second side thereof. The reflectors are also arranged to reflect both the first and second light towards the label of the at least one product.

The reflector may be a plate reflector. The plate reflector may be formed by a suitably folded plate. For instance, the reflector may comprise reflecting surfaces defining in cross-section essentially a V-shape. The angle (a) between the ends of the V-shape may be in the range of 60°-180°.

In an embodiment the angle between the ends of the V-shape varies over the height of the reflector. In a preferred embodiment the angle at the upper end is smaller than the angle at the lower end of the reflector.

In an embodiment the reflector comprises one or more reflecting surfaces for reflecting UV light from the UV light emitters, reflecting surfaces defining a combined reflecting area that is generally convex so that the UV light may be distributed more uniformly over the label.

In an embodiment the one or more reflecting surfaces of a reflector extend in upright direction. The upright direction may be defined as a direction perpendicular to the transport direction of the conveyor and/or parallel to the longitudinal axis of the products when the products are placed on the product conveyor.

The reflector surface may extend orthogonal to the transport surface of the product conveyor but may also be inclined relative to the transport surface. This inclination may be caused by a suitable shape of the reflector and/or by the reflector arrangement unit holding the reflector at a suitable orientation relative to the products In specific embodiments the one or more reflecting surfaces of a reflector are inclined relative to the upright direction. An oblique reflector surface may be achieved by a reflector arrangement unit that is configured to position the reflecting surfaces of the reflector to extend obliquely relative to the longitudinal axis of the products. Alternatively or additionally, the reflector may have to this end a varying thickness. The oblique orientation of the reflector surface(s) is provided so as to direct the light to a suitable part of the product. The surface may be inclined downward towards a lower end of the product when the label is to be attached to a lower part (for instance, near the bottom of the product) or towards an upper part of the product when the label is to be attached at the top of the product.

In an embodiment the UV light emitters are arranged so as to irradiate at the same time a first reflector facing the trailing portion of a shrinkable label of a first product and a second reflector facing the leading portion of a shrinkable label of a second product.

The reflector arrangement unit may be placing unit placing a reflector between consecutive products and removing the same once the label has been properly attached to the product. In such embodiments the product conveyor is stopped before the reflector is placed and the UV light emitters start to emit light. The product conveyor is started again when the product has been labelled and the reflector has been removed again. However, to allow an increased handling speed the reflector arrangement unit is preferably embodied as a reflector conveyor that allows the reflectors to be moved together with the movement of the products. The reflector conveyor may be of various types, such as a vertical or horizontal carousel type of conveyor. In preferred embodiments the reflector conveyor is a horizontal, loop-like conveyor. The reflector conveyor is preferably configured to transport the at least one reflector synchronously with the at least one product. In certain embodiments the reflector arrangement unit comprises a reflector conveyor being configured to transport a plurality of reflectors, wherein in the irradiation volume the speed of the reflector conveyor corresponds with the speed of the product conveyor.

In an embodiment the apparatus further comprises one or more diverging lens elements so as to provide a divergent light beam on both the label and the one or reflectors.

According to a further aspect a system for attaching a shrinkable label to a product is provided wherein the system comprises the apparatus as defined herein, in combination with the product conveyor configured to transport a plurality of products to be labelled.

In an embodiment the controller is configured to control the product conveyor, reflector conveyor and UV light emitters to transport the products intermittently, wherein in the periods wherein the product is stopped the at least one reflector is placed at a position between consecutive products and/or removed from a position between consecutive products and wherein the periods wherein the product is moving, the label of the product is irradiated with UV light.

Further characteristics of the present invention will be elucidated in the accompanying description of various preferred embodiments thereof. In the description reference is made to the annexed figures.

Figure 1:
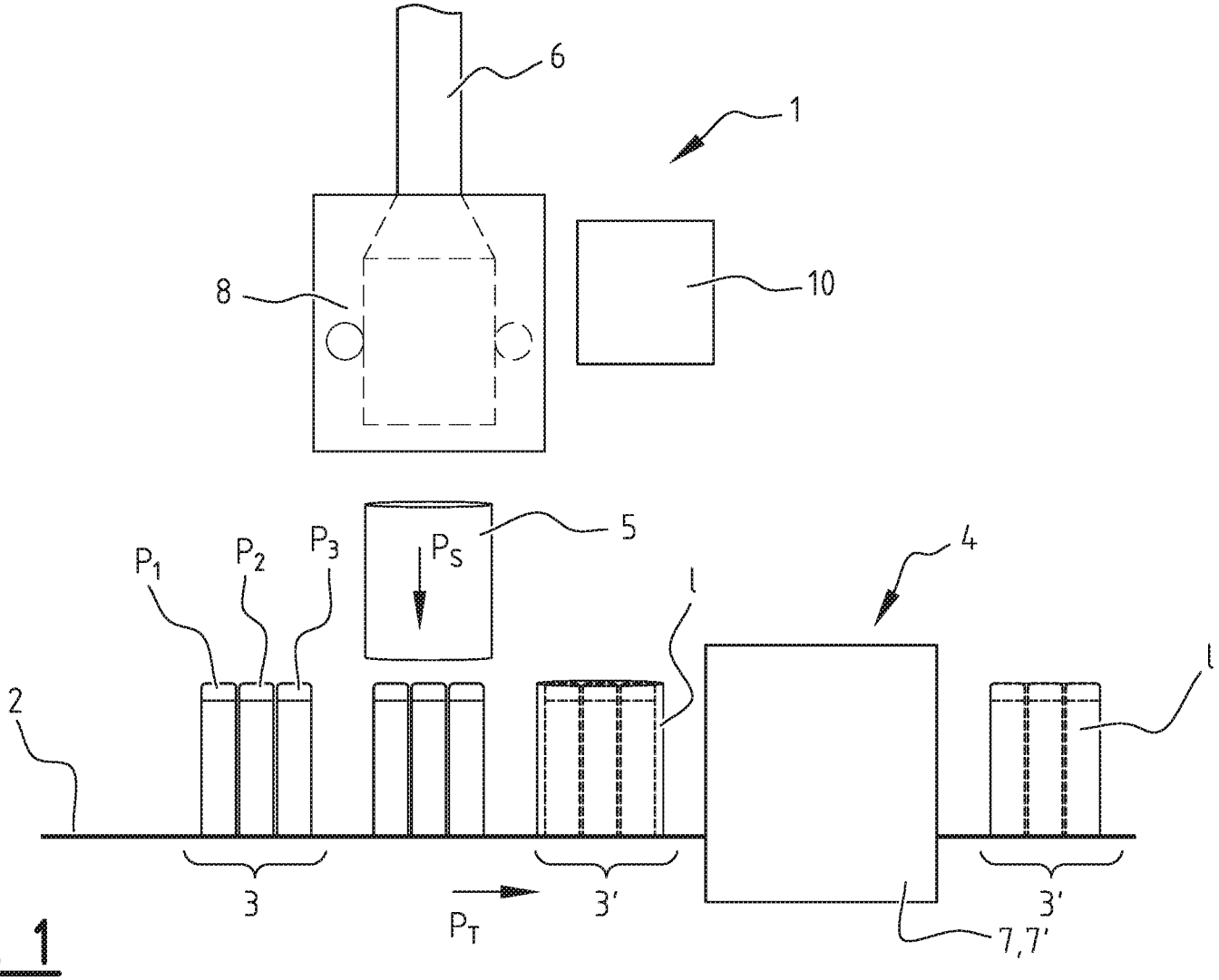
FIG. 1 is a schematic side view of an attachment system including an attachment apparatus as defined herein.

Unless defined otherwise, all technical terms used herein have the same meaning as commonly understood by one of ordinary skill in the art to which this invention belongs. Still, certain elements are defined below for the sake of clarity and ease of reference. Furthermore it is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope of the present invention. Any recited method can be carried out in the order of events recited or in any other order which is logically possible.

The products to be handled may be, for instance, containers, bottles, receptacles, holders for holding a variety of types of foodstuff or non-foodstuff materials, etc. The products may be labelled individually (i.e. each product receives its own label) and/or jointly (i.e. the products are combined into respective packages, each package containing two or more products, wherein the package as a whole is to be labelled). When throughout the present specification reference is made to a product this reference is to include a package of multiple products and vice versa, unless stated otherwise.

The heat shrinkable label material used may comprise of a mono-layer or a multi-layered film to be attached to a product. For instance, the multi-layered film may comprise a base layer film and a photothermic layer. The photothermic material is a material that causes the generation of thermal energy (heat) when the material is irradiated with electromagnetic radiation, such as light, for instance ultraviolet light (UV light). More specifically, the electromagnetic radiation produces the photoexcitation of the material, resulting in the production of thermal energy (heat). The photothermic material may be formed in one or more separate layers or may be combined with the base material. Furthermore, in case of the use of a photothermic layer the photothermic layer may also be a combined photothermic and design layer, for instance a combined photothermic and design layer that has been printed on top of the base layer film, or a combined photothermic and design layer printed below the base layer film. The bottom or lower side of a film is herein defined as a side of the film that faces or touches the outer surface of the product when applied onto said product, whereas a top or upper side of the film relates to a side of the film that faces the source of electromagnetic radiation when the layer is irradiated.

Various embodiments of a multi-layered film used in the present disclosure are described in WO 2017/213506 A1, especially in connection with any of FIGS. 1A-1G and 2A-2C thereof, the description of which is herein included by reference.

FIG. 1 shows schematically an attachment system 1 configured to attach sleeve-shaped labels 5 on a number of products $P_1$, $P_2$, $P_3$ transported on a conveyor 2, for instance an endless belt conveyor wherein the product $P_1$, $P_2$, $P_3$ may be carried on a conveyor belt. In the figure the products $P_1$, $P_2$, $P_3$ have been combined into respective product packages 3, each comprising three products. In other examples the number of products to be labeled may vary, for instance 1, 2, 3, 4, 5 or even more products.

Tubular foil material 6, for instance a flattened tube formed of mono-layer or multi-layer material as described herein, is supplied and passed through a sleeving device 8. The sleeving device 8 is configured to open the tubular foil 6, cut the tubular foil 6 at a right length to generate a sleeve-shaped label 5 and to eject the sleeve-shaped label 5 in the direction of $P_S$ towards a package 3 of three products $P_1$, $P_2$, $P_3$ that are being transported in transport direction $P_T$ on the conveyor 2. Once the sleeve-shaped label 5 has been arranged around the package 3 (which label is denoted in FIG. 1 with reference "1" in a status wherein it is positioned loosely around the package) the package 3 continues to be transported further towards an attachment apparatus 4 that forms part of the attachment system 1. The attachment apparatus 4 comprises two sets of UV light units 7,7' arranged on either side of the conveyor 2.

Each of the UV light units 7,7' may comprise a plurality of UV light sources, preferably LED light sources. The UV light sources may be of the type having a peak wavelength between 200 and 399 nm and having at least 90% of the UV light within a bandwidth of +/−60 nm or +/−30 nm of the peak wavelength. In some examples the UV light has a peak wavelength between 300 nm and 395 nm or even between 350 nm and 390 nm, while at least 90% of the UV light is within a bandwidth of +/−60 nm of the peak wavelength, and preferably between +/−30 nm of the peak wavelength. In a preferred example the wavelength is 385 nm (+/−20 nm).

The UV light units 7,7' define between them an irradiation volume into which one or more consecutive (packages 3 of) products $P_1$, $P_2$, $P_3$ can be moved. During the residence time in the irradiation volume the label (1) arranged around the (package 3 of) products $P_1$, $P_2$, $P_3$ can be illuminated by both UV light units 7,7' so as to attach the sleeve-shaped label. The attachment apparatus 4 is configured to allow the sleeve or label (1) to be firmly attached at the right position to the product $P_1$, $P_2$, $P_3$ in order to provide a sleeved package 3' of products.

Examples of a sleeving device 8 for applying a sleeve-shaped label 5 on a moving product $P_1$, $P_2$, $P_3$ are given in WO 013/073938 A1 in case of a downsleeving machine and WO 2014/006033 A1 in case of an upsleeving machine. The description of the sleeving system in either of these documents is herein incorporated by reference. In the sleeving systems of WO 2013/073938 A1 and WO 2014/006033 A1 the sleeve that has been arranged around the moving product $P_1$, $P_2$, $P_3$, is shrunk in an oven wherein the shrinkable material of the label is heated up, for instance by guiding the product along a number of vapor nozzles. In the attachment system 1 of FIG. 1, however, the oven is replaced by the attachment apparatus 4. As mentioned before, this attachment apparatus 4 is configured to generate electromagnetic radiation, especially ultraviolet (UV) light, which UV light is irradiated onto the label on the product inside the irradiation volume positioned in the attachment apparatus 4 between the light units 7,7' so that the photothermic material in the label is heated up and the shrinkable material of the label is caused to shrink the label around the product.

The attachment apparatus 4, preferably also the sleeving device 8, and the conveyor 2 are connected to a controller 10. The controller 10 may be configured to control the UV-light emitters to irradiate the one or more shrinkable labels (1) arranged on the one or more products $P_1$, $P_2$, $P_3$ in the above-mentioned irradiation volume in order for the photothermic material to heat up causing the heat shrinkable material to shrink around the one or more products.

Figure 2:
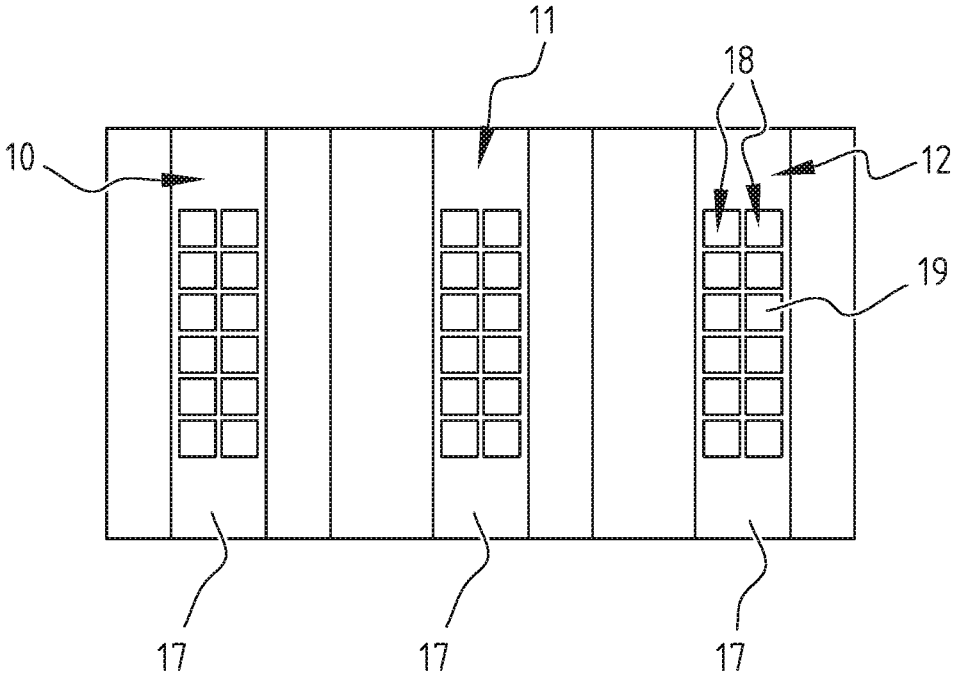
FIG. 2 is a front view of an embodiment of a light unit comprised of three light emitting units.

FIG. 2 is a front view of an embodiment of a light unit 7,7'. The light unit 7,7' comprises three light emitting units 10, 11, 12, placed in an abutting manner next to each other. Each light emitting unit 10, 11, 12 comprises a generally elongated box-shaped housing 15 (shown in FIG. 3) forming an emitter support for supporting a plurality of strips 16 of UV light emitters 19. The UV light emitters 19 are connected through cable to a power supply (not shown). One of longitudinal (upright) side surfaces of the housing 15, i.e. the side surface facing the irradiation volume and therefore facing the products when they are transported on the conveyor, is provided with an elongated window 17 through which UV light emitted by the individual UV light emitters 19 can pass. The elongated window 17 may comprise a glass window that functions as a lens so as to diffract the incoming UV light to exit the light emitting unit 10,11,12 in a divergent manner. This is indicated by reference number 18 in FIG. 5 denoting the "rays" of UV light emitted by the light emitting unit 10,11,12.

Each of the strips 16 of UV light emitters 19 may be formed by a carrier on which a plurality of LED emitters have been mounted. In a particular embodiment the strip 16 is a LED strip (also known as an LED tape or ribbon light) comprising a flexible circuit board populated by surface mounted light-emitting diodes (SMD LEDs). The LED light emitters are connected to a common driver (not shown) that drives the LED emitters at a suitable voltage.

In embodiments the distribution of the UV light emitters 19 is such that there is no area wherein the provided light distribution has an intensity of less than 550 mW. The UV light emitters 19 may be of the type NVSU233A 385 nm (LED produced by NICHIA) providing a specified light intensity.

The light emitting units 10,11,12 may be arranged such that a (straight or arched) wall-like structure sideways of the conveyor 2 is obtained. For instance, windows 17 of the light emitting units 10,11,12 of a first light unit 7 can be placed parallel to and close to either side of the trajectory of the products $P_1$, $P_2$, $P_3$ on the conveyor 2. Similarly, windows 17 of the light emitting units 10,11,12 of the first light unit 7' can be arranged at the opposite side of the trajectory, also in a direction generally parallel to the transport direction of the product $P_1$, $P_2$, $P_3$. In this manner the product $P_1$, $P_2$, $P_3$ may be illuminated from both longitudinal sides (seen in transport direction from the left and right side) so that the label (1) on the products $P_1$, $P_2$, $P_3$ moving pass the UV light emitters 19 are illuminated during transportation.

Figure 3:
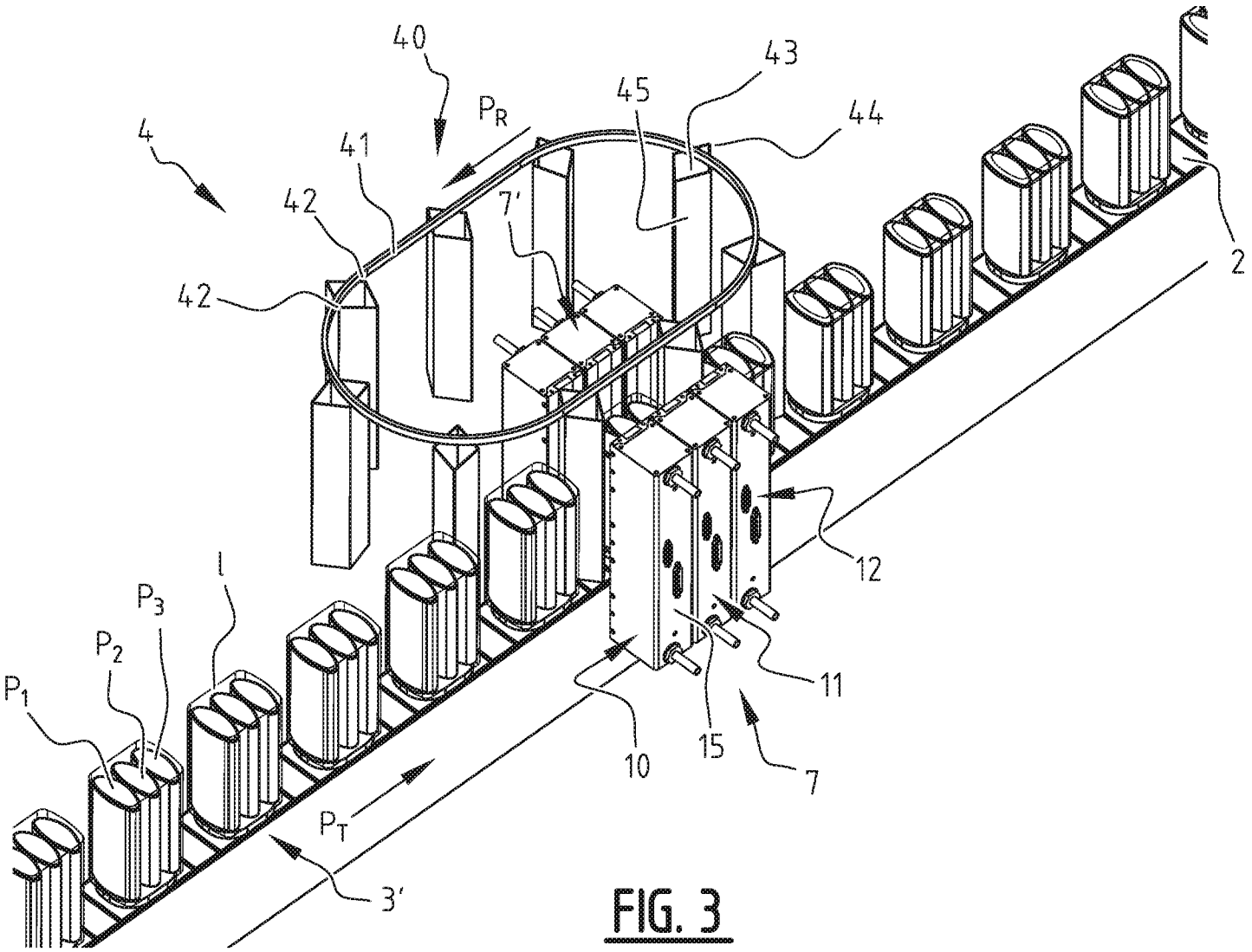
FIG. 3 is a schematic side view in perspective of an embodiment of an attachment system including an attachment apparatus.
Figure 4:
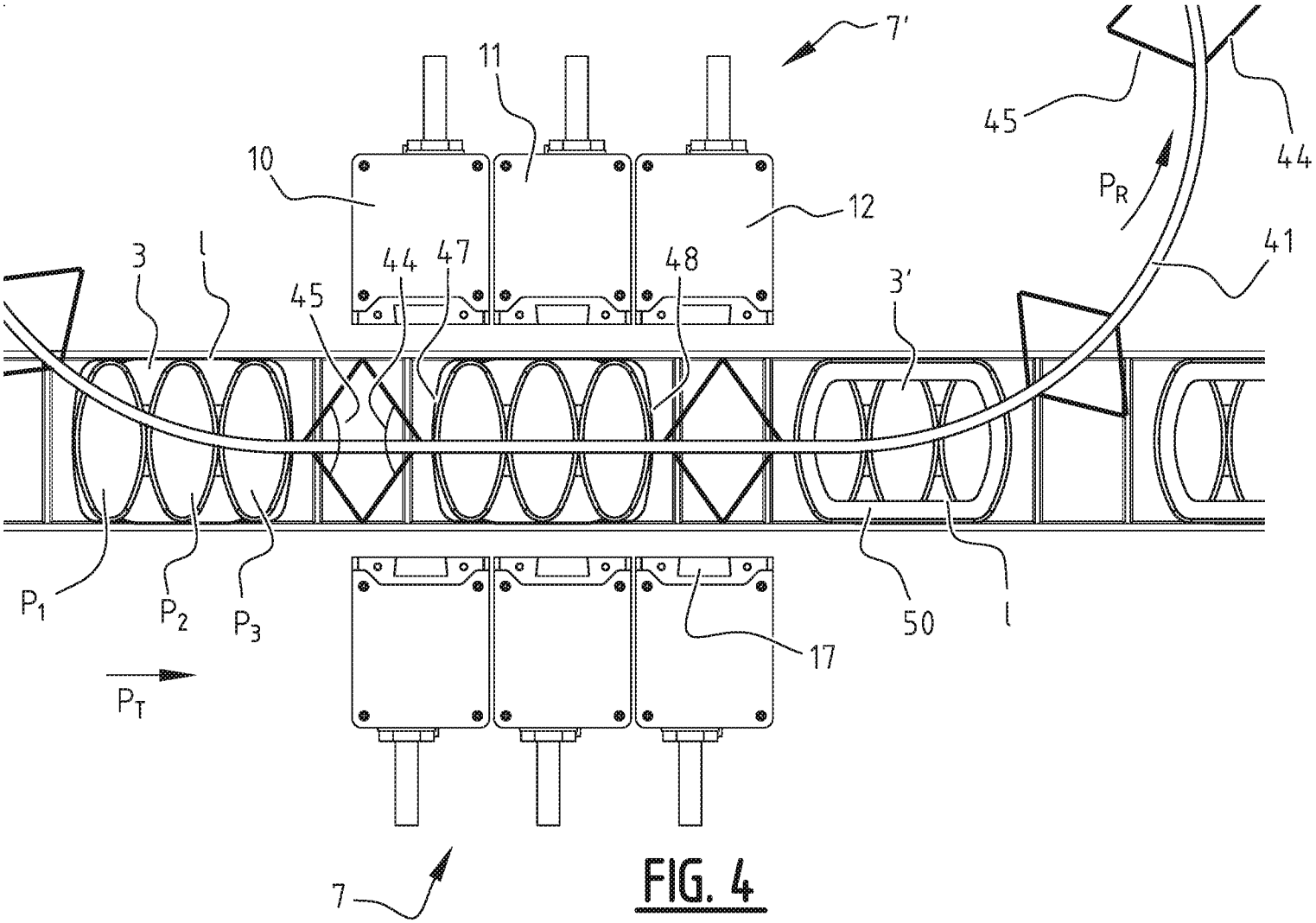
FIG. 4 is a top view of the embodiment of FIG. 3.

FIGS. 3 and 4 respectively are a perspective side view and a top view of an embodiment of an attachment apparatus 4. The figures show a conveyor 2 on which a row of packages 3 containing three products $P_1$, $P_2$, $P_3$ are transported in a transport direction $P_T$. The conveyor 2 may be configured to transport the packages 3 in an intermittent manner or, preferably, in a continuous manner. Furthermore, the packages 3 carried by the moving part of the conveyor 2, for instance the packages placed on the endless conveyor belt, are maintained fixedly on the conveyor 2 so that they are stationary relative to the moving part (for instance, the endless conveyor belt) of the conveyor 2. Each of the packages 3 arrives with a shrinkable label (1) arranged loosely around the outer surface of the package 3. In the shown example the label (1) have essentially the same height as the products $P_1$, $P_2$, $P_3$ or are slightly higher so that once the label (1) have been shrunk around the packages 3 (cf. the packages 3' at the downstream side of the attachment apparatus 4), the upper part 50 (FIG. 4) of the label (1) is partially shrunk around the top end of the products $P_1$, $P_2$, $P_3$. Similarly, the bottom end of the products 3' may be partially covered by the label (1). In other embodiments, however, for instance in embodiments wherein the products $P_1$, $P_2$, $P_3$ themselves are sleeved instead a combination of products $P_1$, $P_2$, $P_3$ in the package 3', the label (1) may also be applied only to a portion of the outer surface of the product $P_1$, $P_2$, $P_3$ or package 3', for instance close to the bottom end, close to the top end or at an intermediate position between the top and bottom end of the product/package 3'). Depending on the target size and position of the label (1) on the product $P_1$, $P_2$, $P_3$ or package 3', the properties of the reflectors may need to be varied to provide an optimal irradiation of the labels (1), as will be explained later.

FIGS. 3 and 4 also show a first light unit 7 placed at the right side of the conveyor 2 (seen in transport direction $P_T$) and second light unit 7', facing the first light unit 7', placed at the left side of the conveyor 2. Each of the light units 7,7' comprises three light emitting units 10, 11, 12. In other embodiments each light unit comprises fewer or more light emitting units 10-12, the number of light emitting units being dependent on, for instance, the transport speed of the conveyor 2, the number and type of light sources in each of the light emitting units 7,7', etc. The first and second light units 7,7' are positioned at a certain mutual distance and define between them an irradiation volume in which one or more products or one or more packages at the same time may be irradiated with the UV light from the light sources.

FIGS. 3 and 4 also show an embodiment of a reflector arrangement unit 40 for arranging the reflector unit 43 at positions between consecutive (packages of) product. More specifically, in this embodiment, the reflector arrangement unit 40 is a reflector conveyor configured to transport reflector unit 43 in such a manner that they are properly placed between consecutive (packages 3' of) products $P_1$, $P_2$, $P_3$ when the products $P_1$, $P_2$, $P_3$ are moved through the irradiation volume. The reflector arrangement unit 40 comprises a transport rail 41 on which a number of movable carriages 42 are mounted. Suspended from the carriages 42 are reflector units 43. In the embodiment shown in FIGS. 3 and 4 each reflector unit 43 comprises two reflectors, i.e. a first reflector 44 (forward facing reflector) and a second reflector 45 (rearward facing reflector). The first and second reflectors 44,45 are oriented such that when the reflector unit 43 is arranged between a first and second package 3' of products, the first reflector 44 faces a trailing portion of a first package 3' and the second reflector 45 faces a leading portion of the package 3. In other embodiments, for instance the embodiment shown in FIG. 4, each reflector unit 43 only has two reflectors 44, 45. The carriages 42 may be moved along the transport rail 41 by a drive motor (not shown). In embodiments of the present disclosure the reflector arrangement unit 40 is configured to convey the reflector unit 43 at a transporting speed of the carriages 42 that is substantially the same as the transport speed of the products/packages (i.e. the conveyor speed of the conveyor 2). Furthermore, the product conveyor 2 and the reflector arrangement unit 40 move synchronously so that the reflector unit 43 is arranged between consecutive products $P_1$, $P_2$, $P_3$ or product packages 3'. Preferably the reflector unit 43 is arranged halfway between two consecutive products or product packages.

In some of the embodiments wherein the reflector unit 43 has two opposing reflectors 44, 45 the distance in the transport direction $P_T$ between the forward facing reflector 44 and the trailing portion 47 of the label (1) is the same as the distance between the rearward facing reflector 45 and the leading portion 48 of the label (1) so that the trailing and leading portions 47, 48 of the label (1) receive essentially the same amount and the same distribution of light from the reflector unit 43. However, in other embodiments the mutual distances may vary, for instance in order to provide one side of the package a different light distribution than the other, opposite side of the package.

Figure 5:
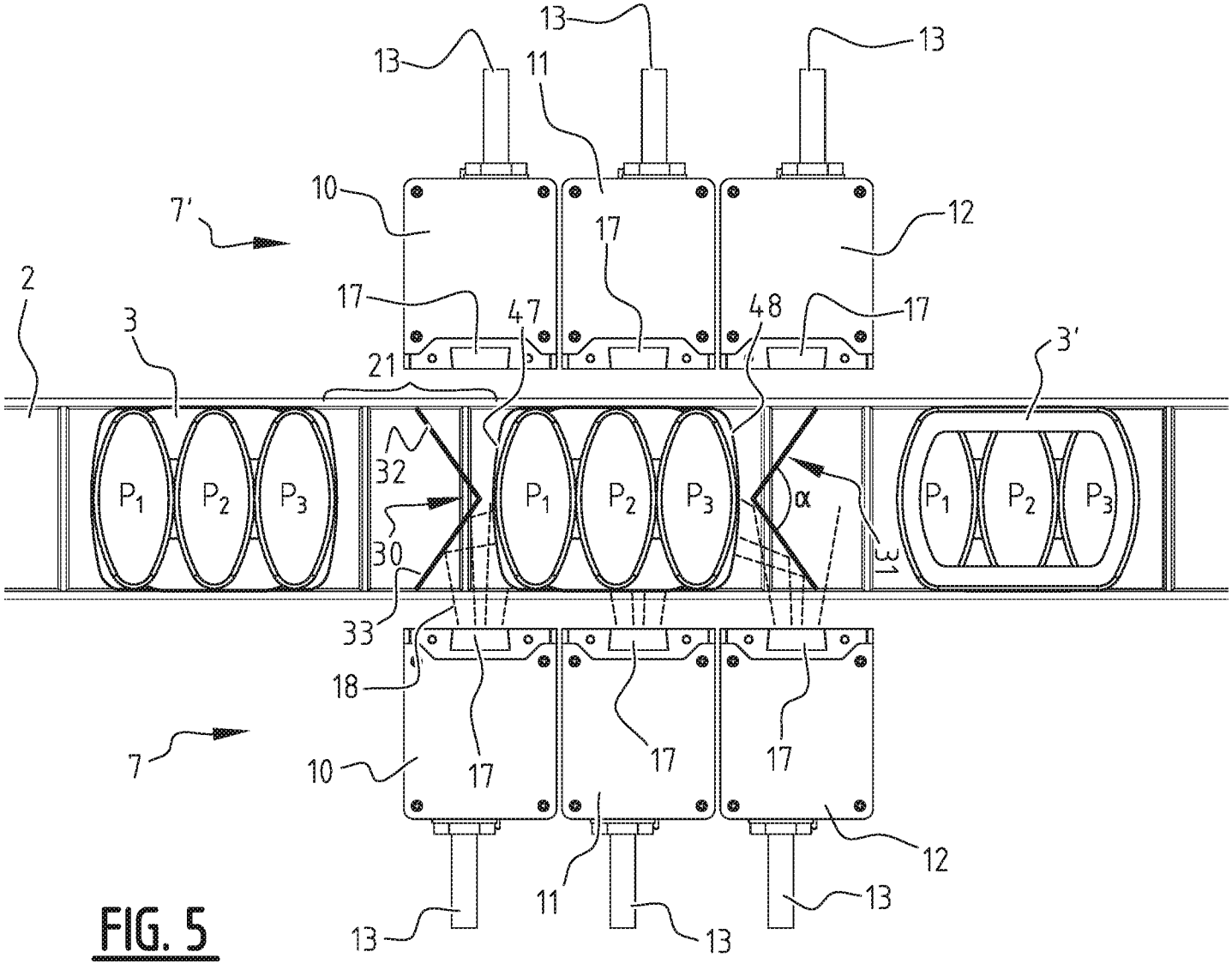
FIG. 5 is a top view of a further embodiment of the attachment system.

FIG. 5 shows an embodiment wherein only one reflector unit is used to sandwich each of the consecutive (packages of) products. In this embodiment, the reflector unit 43 may not be moved with the horizontal transport rail disclosed in FIGS. 3, 4, but may be moved with an vertical transport unit which moves down the reflector unit from the above the products when the product is placed in the irradiation volume, and moves up the reflector unit to let the container being conveyed once the label (1) is attached to the product. In the embodiment of FIG. 5, the distance between the forward facing reflector 30 of the reflector unit 43 and the trailing portion 47 of the label (1) may be the same as the distance between the rearward facing reflector 31 of the reflector unit 43 and the leading portion 48 of the label (1) so that the trailing and leading portions 47, 48 of the label (1) receive essentially the same amount and the same distribution of light from the reflector unit 43. In this embodiments, however, the reflector unit 43 does not need to be placed halfway between consecutive (packages of) products. In other embodiments the mutual distances may vary, for instance in order to provide one side of the package a different light distribution than the other, opposite side of the package.

A reflector 30, 31, 44, 45 may formed by a plate reflector that has been folded into a V-shape so that two reflector surfaces 32,33 (FIG. 5) are created, the first reflector surface 32 being configured to primarily receive light from the second light unit 7' at the left side of the conveyor 2, while the second reflector surface 33 is configured to primarily receive light from the first light unit 7 positioned at the right side of the conveyor 2. The angle (a) between the reflector surfaces 32,33 may be constant or may vary over the height of the reflector, as will be discussed in connection with FIGS. 8A and 8B.

The reflectors and their reflective surfaces may be made of various materials. In exemplifying embodiments of the present disclosure the reflectors are made of aluminum, for instance DUV Enhanced Aluminum or UV Enhanced Aluminum.

In operation, the products are transported along the light units 7,7'. As mentioned earlier, the products and irradiation volume formed by the UV light emitters 19 may be arranged to continuously or intermittently move relative to each other. For instance, the conveyor 2 may transport the products intermittently and the irradiation may be performed in the time intervals in which the products are stopped. In other embodiments the products are transported continuously and the irradiation is performed during movement of the products.

The latter embodiments are preferred in most situations since continuous movement of the conveyor 2 enables an increased handling speed of the products. While the products $P_1$, $P_2$, $P_3$ are being transported, the products $P_1$, $P_2$, $P_3$ are irradiated with light from both light units 7,7'. The elongated side surfaces of the labels (1) are illuminated directly from the light of the light emitting units 10-12. Also the trailing and leading portions 47,48 of the labels (1) may receive light directly from the light emitting units 10-12. Additionally, the trailing and leading portions 47,48 of the labels (1) receive light in an indirect manner via the reflectors. In this manner a more even distributed illumination of the label (1) around its entire circumference may be achieved, so that the label (1) may be more uniformly shrunk around the (package 3' of) products $P_1$, $P_2$, $P_3$. In this way the labelling quality of the products/packages may be increased. A further advantage is that the labelling speed (i.e. the time needed for labelling a product or a package of products) may be increased as well, with a relatively compact set of light units 7,7'. In situations without the presence of reflectors the movement of the products $P_1$, $P_2$, $P_3$ needs to be halted or at least the conveyor speed determining the speed at which the products pass the light units 7,7' should be kept relatively low in order for the label (1), especially the trailing and leading portions 47, 48 of the label (1), to be properly attached to the products $P_1$, $P_2$, $P_3$.

Figure 6A:
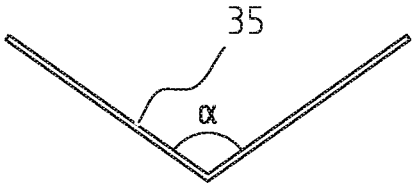
FIGS. 6A-6C are cross-sections of various embodiments of (portions of) a reflector of an attachment apparatus.
Figure 6B:
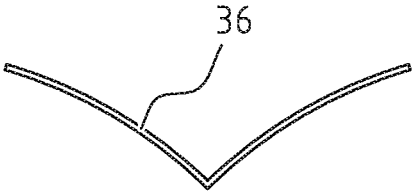
Figure 6C:
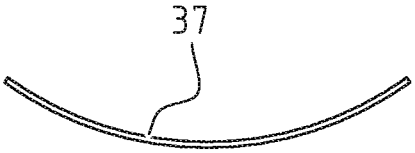

FIGS. 6A-6C show cross-sections of various embodiments of (portions of) a reflector 30,31,44,45 of a reflector unit 43 as shown in any of FIGS. 3-5. Each of the reflectors has a generally convex shape. In FIG. 6A the convex reflector 35 is essentially V-shaped. The angle (a) between the ends of the V-shape may be constant (for instance shown in the embodiment of FIG. 3) or may vary along the height of the reflector. The angle (a) is preferably in the range of 60°-180°.

Figure 8A:
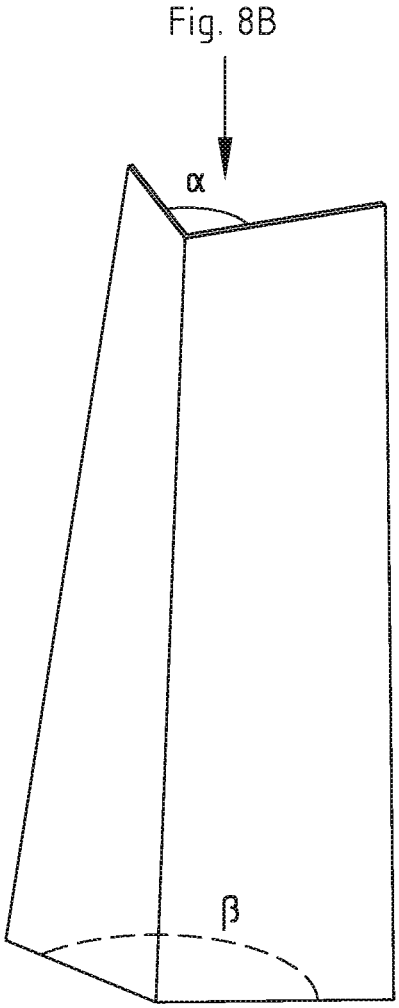
FIGS. 8A and 8B are a side view and a cross-section of a further embodiment of a reflector of an attachment apparatus.
Figure 8B:
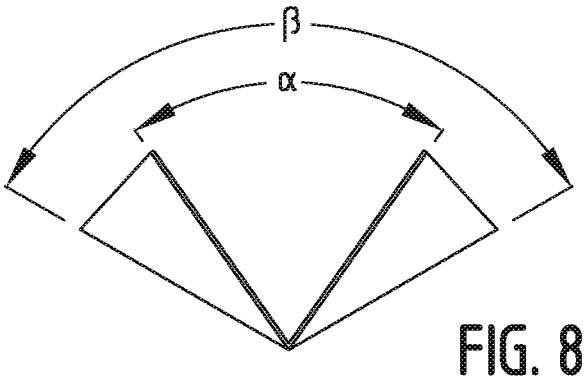

An embodiment with a varying angle is elucidated in FIGS. 8A and 8B. FIGS. 8A and 8B show a reflector in the shape of a folded flat plate. The plate has been folded so that in each cross-section the (plate) reflector remains essentially V-shaped. The angle between the ends of the V-shape varies over the height of the plate reflector: at the upper end the angle (a) between the plate ends is smaller than angle (β) at the lower end of the plate. In other embodiments the angle (a) between the plate ends is larger than angle (β) at the lower end, while in still other embodiments both angles (α,β) are equal.

FIG. 6B shows an embodiment of a convex reflector 36 still having an essentially V-shape. In this embodiment the ends of the V-shape are not straight (as in FIG. 6A) but they are slightly curved. In this manner the distribution of light on the trailing and leading portions 47, 48 of the label (1) may be adopted, for instance depending on the shape and position (height) of the label (1). Also in this type of convex reflector the angle (α) between the straight reflector parts bordering the fold may be constant or varying over the height of the reflector.

FIG. 6C shows an embodiment of a convex reflector 37 that is entirely curved and does not have a fold. Also in this manner the distribution of light on the trailing and leading portions 47, 48 of the label (1) may be adopted, for instance depending on the shape and position (height) of the label. These embodiments of convex reflectors are selected depending on the shape of the product/package, the strength of UV light, the locations of the UV light emitters, the conveying speed of the product or the like.

Figure 7A:
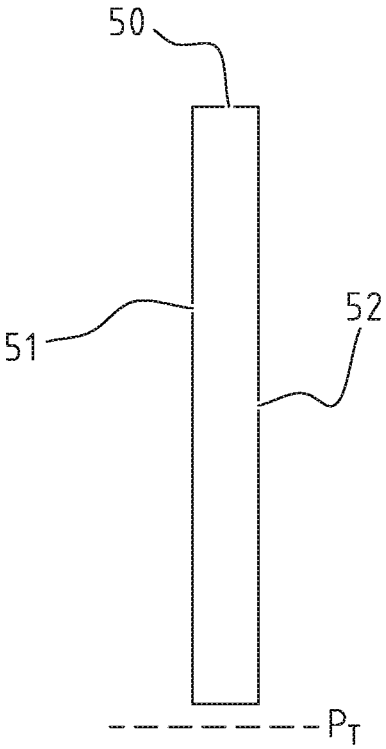
FIGS. 7A-7C are respective longitudinal sections of various embodiments of (portions of) a reflector of an attachment apparatus.
Figure 7B:
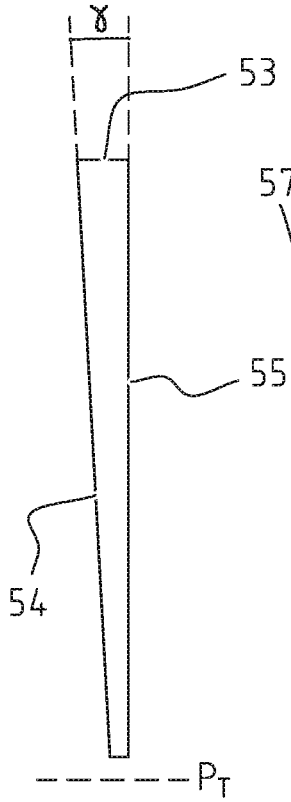
Figure 7C:
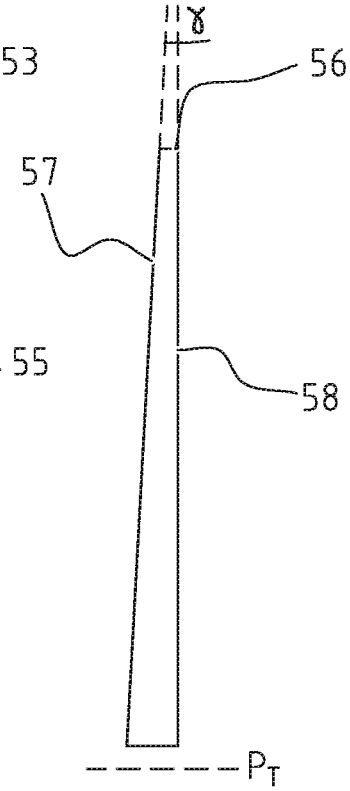

FIGS. 7A-7C show respective longitudinal sections of various embodiments of (portions of) a reflector 30,31,44,45 of a reflector unit 43 as shown in any of FIGS. 3-5. FIG. 7A shows an embodiment wherein the thickness of the reflector 50 is constant over the height of the reflector 50. One or more of the opposing surfaces 51, 52 of the reflector may be reflective. In FIGS. 7B and 7C embodiments are shown wherein the orientation of one or more of the reflecting surfaces 54,55,57,58 of the reflector 53,56 is oblique relative to the transport direction (for instance, the horizontal direction in case the products are transported on a horizontal conveyor 2). In other words, at least one of the reflecting surfaces 54,57 of the reflector 53,56 comprises a plane inclined at an angle (γ) relative to a direction perpendicular to the transport direction $P_T$, i.e. inclined over an angle (γ) relative to the upright direction. In case of a horizontal conveyor surface on which the products are placed (cf. FIG. 1), the angle (γ) is relative to the vertical direction.

This at least one inclined reflecting surface 54,57 may be accomplished by varying the thickness of the upper portion of the reflector 53,56, by appropriately arranging the reflector in an oblique position relative to the transport direction $P_T$, by appropriately folding a plate-like reflector such as the reflector of FIGS. 8A and 8B and/or by any other means.

Furthermore, the reflecting surface 54 of the reflector 53 may be oriented to face slightly downward, as is shown in FIG. 7B. The opposite surface 55 of this reflector 53 may be or may not be reflective. In this embodiment the inclination of the reflecting surface 54 is such that the light radiation received from the light units 7,7' are reflected in a slightly downward direction. In this manner the bottom edge of the label (1) might receive more radiation than higher parts of the label (1). This results in the bottom edge of the label (1) to be attached first to the product, and only thereafter the remaining part of the label (1) is attached to the product.

Similarly, the reflector can be reflecting surface 57 in FIG. 7C which is inclined with respect to the opposite direction to reflect light in a slightly upward direction, so that the top edge of the label (1) may receive more radiation than the bottom edge of the label (1) so that the label (1) will be attached first at the top edge and then the remaining part of the label (1) follows and is attached to the product as well.

The preceding merely illustrates the principles of the present invention. It will be appreciated that those skilled in the art will be able to device various arrangements, which, although not explicitly described or shown herein, embody the principles of the invention and are included within the scope of the appended claims.

The invention claimed is:

1. Apparatus for attaching a shrinkable label to at least one product, wherein the shrinkable label comprises a film comprising heat shrinkable material and photothermic material and wherein the at least one product is transported on a product conveyor through an irradiation volume, the apparatus comprising:

a plurality of UV light emitters arranged sideways of the product conveyor, the UV light emitters defining the irradiation volume and being configured to irradiate at least one shrinkable label arranged around the at least one product while the at least one product is transported through the irradiation volume;

a reflector arrangement unit for arranging at least one reflector between consecutive products on the product conveyor while the at least one product is being transported, the reflector arrangement unit comprising a transport rail on which a number of movable carriages are mounted and suspended from the carriages are reflector units, each reflector unit comprising at least one reflector configured to reflect UV light from the UV light emitters towards the shrinkable label;

a controller configured to control the UV-light emitters to emit UV-light towards the shrinkable label arranged around the at least one product in the irradiation volume and towards the at least one reflector arranged between consecutive products in order for the photothermic material of the shrinkable label to heat up causing the heat shrinkable material to shrink around the at least one product.

2. The apparatus as claimed in claim 1, wherein the reflector arrangement unit is configured to arrange one or more reflectors at one or more positions between consecutive products on the product conveyor, wherein the at least one reflector is configured to reflect the UV light from the UV light emitters towards at least one of a leading portion and a trailing portion of the shrinkable label, wherein the reflector arrangement unit is configured to position a first reflector to face the trailing portion of the shrinkable label and a second reflector to face the leading portion of the shrinkable label, wherein the first and second reflectors are configured to reflect UV light towards both the leading portion and the trailing portion of the product.

3. The apparatus as claimed in claim 1, comprising a reflector arrangement unit comprising a first reflector arranged to face the trailing portion of a shrinkable label of a first product and a second reflector arranged to face the leading portion of a shrinkable label of a second product, wherein the reflector arrangement unit is configured to place the reflector unit between consecutive products on the product conveyor.

4. The apparatus as claimed in claim 1, wherein the reflector is made of aluminum, DUV Enhanced Aluminum, or UV Enhanced Aluminum.

5. The apparatus as claimed in claim 1, wherein the reflector is configured to receive both first light from a first set of UV light emitters arranged next to the product conveyor at a first side thereof and second light from a second set of UV light emitters arranged next to the product conveyor at an opposite, second side thereof, and to reflect both the first and second light towards the label of the at least one product, wherein the reflector is a plate reflector, and wherein the reflector is formed by a folded plate.

6. The apparatus as claimed in claim 1, wherein the reflector defines reflecting surfaces defining in cross-section essentially a V-shape, wherein the angle (a) between the ends of the V-shape is in the range of 60°-180°, wherein the angle between the ends of the V-shape varies over the height of the reflector, and wherein the angle at the upper end is smaller than the angle at the lower end of the reflector.

7. The apparatus as claimed in claim 1, wherein the reflector comprises one or more reflecting surfaces for reflecting UV light from the UV light emitters, wherein the one or more reflecting surface define a combined reflecting area that is generally convex, wherein the one or more reflecting surfaces of the reflector extend in an upright direction, wherein the one or more reflecting surfaces of the reflector are inclined relative to the upright direction, wherein the UV light emitters are arranged so as to irradiate at the same time a first reflector facing the trailing portion of a shrinkable label of a first product and a second reflector facing the leading portion of a shrinkable label of a second product, the apparatus being configured to have the UV light emitters to directly irradiate at least the side portions of the label and to indirectly irradiate at least the trailing and leading portions of the label, and wherein the reflectors and UV light emitters are configured to substantially uniformly irradiate the label of a product over its entire circumferential surface.

8. The apparatus as claimed in claim 1, wherein the controller is configured to control the reflector arrangement unit and product conveyor to transport the at least one reflector synchronously with the at least one product, wherein the reflector arrangement unit is configured to transport a plurality of reflectors, wherein in the irradiation volume, the speed of the reflector arrangement unit corresponds with the speed of the product conveyor, and wherein the reflector arrangement unit is configured to have the at least one reflector co-move with the at least one product.

9. The apparatus as claimed in claim 1, wherein the reflector arrangement unit is configured to position the at least one reflector at a position aligned with the products, essentially halfway between consecutive products on the product conveyor.

10. The apparatus as claimed in claim 1, wherein the controller is configured to control the product conveyor, reflector arrangement unit and UV light emitters to irradiate one or more labels of one or more products while at the same time moving the one or more products past the UV light emitters, wherein the controller is configured to control the product conveyor, reflector arrangement unit and UV light emitters to transport the products intermittently, wherein in the periods wherein the product is stopped the at least one reflector is placed at a position between consecutive products, removed from a position between consecutive products and wherein the periods wherein the product is moving, the label of the product is irradiated with UV light, wherein the UV light emitters are configured to emit UV light with a peak wavelength between 200 and 399 nm and at least 90% of the UV light within a bandwidth of +/−60 nm or +/−30 nm of the peak wavelength, the UV light emitters are LED UV light emitters, wherein the UV light emitters are arranged to direct UV light substantially transversely of the transport direction of the product conveyor towards the label of the product and to the reflectors, wherein the reflectors are positioned at a predefined distance from the trailing and leading portions of the shrinkable label, wherein the UV light emitters have been arranged in at least one pattern essentially parallel to the transport direction of the at least one product on the product conveyor, wherein the UV light emitters are positioned at one side or at both sides of the product conveyor, the apparatus further comprising one or more diverging lens elements so as to provide a divergent light beam on both the label and the one or reflectors, wherein the plurality of UV emitters are positioned in a pattern comprising a number of rows and columns, the columns extending generally parallel to the axial direction of the product, and comprising transporting the at least one product relative to a plurality of stationary UV light emitters.

11. A system for attaching a shrinkable label to a product, the system comprising the apparatus as claimed in claim 1, the system further comprising a sleeving device configured to apply a sleeve-shaped label around the product.

12. The apparatus as claimed in claim 1, wherein each reflector unit comprises two reflectors, a forward facing reflector facing a trailing portion of the product and a rearward facing reflector facing a leading portion of the product.

13. The apparatus as claimed in claim 1, wherein the reflector arrangement unit is configured to convey the reflector units at a transporting speed of the carriages that is substantially the same as a transport speed of the products on the product conveyor.

14. The apparatus as claimed in claim 1, wherein the product conveyor and the reflector arrangement unit move synchronously so that the reflector units are arranged between consecutive products.

15. The apparatus as claimed in claim 1, wherein the at least one reflector is diamond shaped.

16. The apparatus as claimed in claim 1, wherein the transport rail is located above the product conveyor.

17. The apparatus as claimed in claim 1, wherein the transport rail is oval shaped.

* * * * *